US006836937B1

(12) United States Patent
Boscolo

(10) Patent No.: US 6,836,937 B1
(45) Date of Patent: Jan. 4, 2005

(54) METHOD AND DEVICE FOR PRODUCING A COMPOSITE NONWOVEN FOR RECEIVING AND STORING LIQUIDS

(75) Inventor: Gianni Boscolo, Vlagliano Biellese (IT)

(73) Assignees: Fleissner GmbH & Co. Maschinenfabrik, Egelsbach (DE); Albis S.p.A., Roasio Curavechia (IT)

( * ) Notice: Subject to any disclaimer, the term of this patent is extended or adjusted under 35 U.S.C. 154(b) by 92 days.

(21) Appl. No.: 10/049,846

(22) PCT Filed: Aug. 5, 2000

(86) PCT No.: PCT/EP00/07621

§ 371 (c)(1),
(2), (4) Date: Nov. 20, 2002

(87) PCT Pub. No.: WO01/14624

PCT Pub. Date: Mar. 1, 2001

(30) Foreign Application Priority Data

Aug. 19, 1999 (DE) ..... 199 38 809

(51) Int. Cl.[7] ..... D04H 5/02
(52) U.S. Cl. ..... 28/104; 28/103
(58) Field of Search ..... 28/104, 105, 167, 28/103, 107, 112, 116, 117; 442/383–385, 387, 408, 413, 389, 381; 156/148, 182, 62.2

(56) References Cited

U.S. PATENT DOCUMENTS 4,100,324 A * 7/1978 Anderson et al. ..... 442/344
4,931,355 A * 6/1990 Radwanski et al. ..... 442/344
4,950,531 A * 8/1990 Radwanski et al. ..... 442/351
5,328,759 A * 7/1994 McCormack et al. ..... 442/402
5,413,849 A * 5/1995 Austin et al. ..... 442/329
5,620,785 A * 4/1997 Watt et al. ..... 428/219
5,883,026 A * 3/1999 Reader et al. ..... 442/382
6,022,818 A * 2/2000 Welchel et al. ..... 442/384
6,063,717 A * 5/2000 Ishiyama et al. ..... 442/387
6,163,943 A * 12/2000 Johansson et al. ..... 28/104
6,177,370 B1 * 1/2001 Skoog et al. ..... 442/387
6,314,627 B1 * 11/2001 Ngai ..... 28/104
6,381,817 B1 * 5/2002 Moody, III ..... 28/104

* cited by examiner

*Primary Examiner*—Amy B. Vanatta
(74) *Attorney, Agent, or Firm*—Antonelli, Terry, Stout & Kraus, LLP

(57) ABSTRACT

Known methods involve applying a layer of particularly highly absorbent fibers such as woodpulp on a carrier nonwoven and then compacting the composite nonwoven with the aid of water entanglement. One disadvantage of the compacting method is the high woodpulp fiber loss and the associated purification of the circulating water for the entanglement device. According to the invention, a fine layer of microfibers is initially applied before applying the woodpulp fibers. The microfibers are evenly distributed on the carrier nonwoven using, for instance, a meltblown process and the woodpulp fibers are only then applied in the separating layer. The water during entanglement can no longer merge the woodpulp fibers into the carrier nonwoven due to the fact that the microfibers act as a barrier.

13 Claims, 1 Drawing Sheet

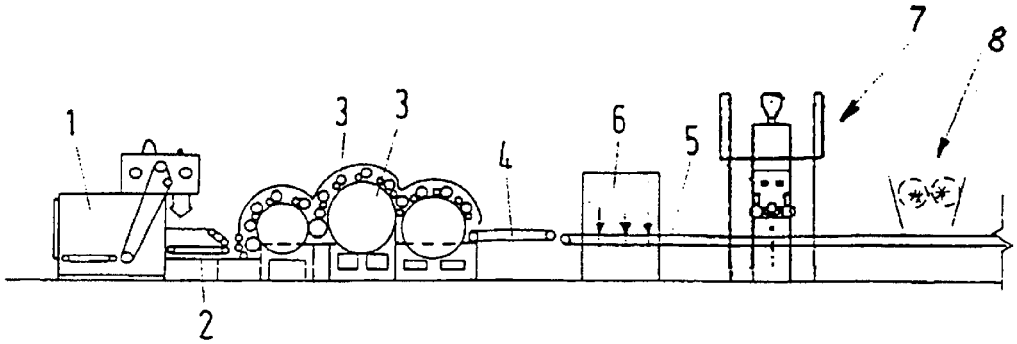
1
2
3
3
4
5
6
7
8
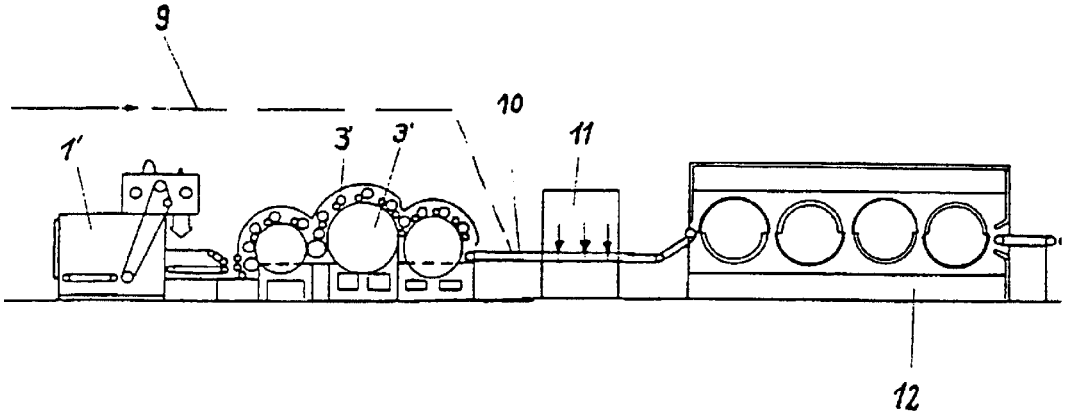
9
10
11
1'
3'
3'
12

METHOD AND DEVICE FOR PRODUCING A COMPOSITE NONWOVEN FOR RECEIVING AND STORING LIQUIDS

BACKGROUND OF THE INVENTION

The invention relates to a method of producing a composite nonwoven for receiving and storing liquids or the like, comprising a carrier nonwoven which, to consolidate it, is e.g. hydraulically needled, and a pulp layer, such as a wood pulp layer, applied to the consolidated carrier nonwoven and brought into secure contact with same. A method of this type emerges from EP 0 540 041. There the carrier nonwoven is hydraulically needled, essentially not to consolidate it but in order to increase the permeability of the carrier nonwoven to liquid. To the carrier nonwoven needled in this way is then applied the super-absorbent pulp in a layer, and the two are brought into good bonding contact and then the composite nonwoven is dried.

It has become apparent that pure consolidation by compression only produces an insufficiently secure contact between the pulp and the carrier nonwoven. A satisfactory connection of the wood pulp fibres to the carrier nonwoven is known e.g. from U.S. Pat. No. 3,560,326 or WO 92/08834, specifically through hydraulic needling of the wood pulp fibres with the consolidated carrier nonwoven. This type of connection results in a high loss of pulp fibres however. Tests have shown that up to 12% of the wood pulp fibres are washed out of the useful layer or bond and are thus lost for the efficiency of the product. Moreover, in this process very many pulp fibres get into the filtration, necessary in the case of water needling, of the circulating water. Due to the additional increased outlay for the purification of the recycled water, the product also becomes more expensive. Water needling at only a low water pressure does not produce the necessary strength; or a stronger carrier nonwoven causes costs which are too high.

SUMMARY OF THE INVENTION

The object underlying the invention is to develop a method and a device necessary for accomplishing this method, by means of which a wood pulp loss of this kind can be avoided during the working cycle of the effective connection to the carrier nonwoven.

To solve the defined problem, provision is made according to the invention for a thin intermediate microfibre layer to be applied, e.g. using the meltblown process, to the consolidated carrier nonwoven, and the layer of pulp fibres only to be applied to this intermediate layer and everything interconnected. Expediently, this connection is also effected by means of hydrodynamic needling. The intermediate layer newly present in such a product acts furthermore advantageously as a barrier for the liquid to be received by the product. However, this barrier layer is not an airtight separating layer which would prevent the breathing activity of the product.

The production of a composite nonwoven solely from unconsolidated textile staple fibres or unconsolidated continuous polymer fibres together with a layer of meltblown microfibres and the hydrodynamic needling of these two layers to connect and consolidate the composite nonwoven is known from EF 0 418 493. There, however, this combination servos to produce a soft, dry nonwoven of a higher strength. Moreover, the nonwoven is intended to be so treated by means of water needling that it has a region of higher strength and one of lower strength. In the idea of the invention, on the other hand, the microfibre layer is intended to produce a separating layer for the wood pulp layer to be applied to it, so that during the process of consolidation by means of water needling, the wood pulp fibres are not washed into the fibres of the carrier layer and thus lost for the product to be produced, with resultant costs.

BRIEF DESCRIPTION OF THE DRAWING

The FIGURE is a schematic view of a device for producing a composite nonwoven according to the present invention.

DETAILED DESCRIPTION OF THE PREFERRED EMBODIMENTS

A nonwoven formed from polyester and/or polypropylene fibres can be considered as the carrier nonwoven. This nonwoven must be first hydraulically needled, i.e. consolidated. Then, to the thus stable carrier nonwoven, a thin layer of a microscopically fine fibre, which is less than 1–5 $\mu$m thick, is sprayed onto the nonwoven in an even distribution. The cooling, ultra-fine fibres in a layer weighinq between 1 and 4 g/m$^2$, preferably 2 g/m$^2$ combine to form a type of film yet do not present any such absolutely dense layer. On this barrier layer are then deposited the pulp fibres e.g. by means of the known air-lay method. This super-absorbent pulp layer is then connected by means of water needling to the carrier nonwoven which is covered by the intermediate microfibre layer, during which process the fine pulp fibres can be no longer or only slightly washed through the carrier unit and thus are retained for the useful effect of the product.

A device for accomplishing the method of the invention is represented in principle in the drawing by way of example.

First of all the carrier nonwoven has to be produced from the polyester fibres and/or the polypropylene fibres. To this end, e.g. a carding machine 1–4 or a spunbonded fabric system, not shown, serves as the wet-laying device. The carding machine comprises a hopper feeder 1 with a vibrating chute 2 disposed below same which transfers the fibres spread evenly over the width to the carding machine with the known carding and spiked rollers 3. The following continuous belt 1 transfers the laid carrier nonwoven to continuous belt which runs first through a water needling device 6, only basically represented, for consolidation. Needling on drums is also conceivable here, as is described in DE-A-197 06 610. In a continuous working cycle, a thin layer of ultra-fine fibres is now applied in an even distribution to the carrier nonwoven by means of device 7 which operates according to the previously known meltblown process. These microfibres form a type of film, which consists however of individual fibres which are laid very closely to one another. On this barrier layer, the pulp fibres are now laid, using the air-lay process, by means of device 8 which is described in detail in EP 0 032 772. Thus the composite nonwoven is produced and only needs to be consolidated and dried. To this end it runs over path 9, shown in broken lines, to continuous belt 10 leading to the needling device 11 which can be constructed similar to device 6. In the perforated drum dryer, the drying can be carried out in a continuous process.

However, it is possible, before the last needling process 11, to lay a further layer of a nonwoven as a cover layer on the composite nonwoven after device 8, in order to bind the pulp fibres better into the end product and thus influence the linting. This purpose is then served by an additional carding machine 1', 3', by means of which an additional nonwoven is laid on the top of the product. Here again, a spunbonded fabric system is possible. Only then is the final water needling process 11 carried out with drying 12.

What is claimed is:

1. Method of producing a composite nonwoven for receiving and storing liquids, comprising the steps of:

providing a carrier nonwoven;

consolidating the carrier nonwoven;

applying a thin intermediate microfibre layer to the consolidated carrier nonwoven;

applying loose pulp fibres to the intermediate layer; and interconnecting at least the pulp fibres with, the intermediate layer.

2. Method according to claim 1, characterised in that the pulp fibres are interconnected to the intermediate microfibre layer and additionally to the carrier nonwoven by means of hydrodynamic needling.

3. Method according to claim 1, further comprising applying a fourth layer as a cover layer to the pulp fibres before the step of interconnecting.

4. Method according to claim 1, characterised in that the step of providing the carrier nonwoven comprises providing a carded nonwoven.

5. Method according to claim 1, characterised in that the step of providing the carrier nonwoven comprises providing a spunbonded nonwoven.

6. Method according to claim 1, characterised in that the step of applying loose pulp fibres comprises air-laying pulp fibres on the intermediate layer.

7. Method according to claim 6, characterised in that the steps of the method are carried out in a continuous system.

8. Method according to claim 1, characterised in that the steps of the method are carried out in a continuous system.

9. Device for accomplishing the method according to claim 1, comprising, in a continuous plant;

a web-laying device to produce a carrier nonwoven, a meltblowing device provided downstream of the web-laying device to apply a fine intermediate layer formed from microfibres on the carrier nonwoven, an air-lay device downstream of the melt blowing device to apply pulp fibres to the fine intermediate layer, and a water needling device provided downstream of the air-lay device to connect at least the pulp fibres to the microfibres.

10. Device according to claim 9, further comp rising a device, for applying a cover layer to the pulp fibres provided between the air-lay device and the water needling device.

11. Device according to claim 9, further comprising another water needing device for pre-consolidating the carrier nonwoven, provided upstream the meltblowing device.

12. Device according to claim 9, characterised in that the web-laying device is a carding machine.

13. Device according to claim 9, characterised in that the web-laying device is a spunbonded fabric system.

* * * * *